US010934860B2

(12) United States Patent
Gibson et al.

(10) Patent No.: US 10,934,860 B2
(45) Date of Patent: Mar. 2, 2021

(54) GAS TURBINE ENGINE COMPONENT WITH PROTECTIVE COATING

(71) Applicant: ROLLS-ROYCE plc, London (GB)

(72) Inventors: Grant J. Gibson, Derby (GB); Matthew Hancock, Derby (GB); Lloyd Pallett, Derby (GB)

(73) Assignee: ROLLS-ROYCE plc, London (GB)

( * ) Notice: Subject to any disclaimer, the term of this patent is extended or adjusted under 35 U.S.C. 154(b) by 413 days.

(21) Appl. No.: 15/602,436

(22) Filed: May 23, 2017

(65) Prior Publication Data

US 2017/0362944 A1 Dec. 21, 2017

(30) Foreign Application Priority Data

Jun. 21, 2016 (GB) ..... 1610768
Apr. 7, 2017 (GB) ..... 1705642

(51) Int. Cl.
*F01D 11/12* (2006.01)
*F01D 5/28* (2006.01)
(Continued)

(52) U.S. Cl.
CPC ..... *F01D 5/288* (2013.01); *C25D 7/008* (2013.01); *C25D 15/00* (2013.01); *F01D 5/02* (2013.01);
(Continued)

(58) Field of Classification Search
CPC ... F01D 5/288; F01D 5/20; F01D 5/02; C25D 7/008; C25D 15/00; C25D 5/12; F05D 2300/6032; F05D 2230/90; F05D 2230/30; F05D 2300/516; F05D 2300/177; F05D 2300/175; F05D 2220/32
See application file for complete search history.

(56) References Cited

U.S. PATENT DOCUMENTS 5,074,970 A * 12/1991 Routsis ..... C25D 5/14 205/122
5,143,383 A 9/1992 Glynn et al.
(Continued)

FOREIGN PATENT DOCUMENTS

DE 102008056741 A1 * 5/2010 ..... F01D 5/288
DE 102008056741 A1 5/2010
(Continued)

OTHER PUBLICATIONS

The Electrodeposition of Platinum and Platinum Alloys, Raub et al., Platinum Metals Rev., 1988, 32, (4), pp. 188-197, https://www.technology.matthey.com/pdf/pmr-v32-i4-188-197.pdf (Raub) (Year: 1988).*
(Continued)

*Primary Examiner* — Daniel J. Schleis
*Assistant Examiner* — Kevin Ct Li
(74) *Attorney, Agent, or Firm* — Oliff PLC

(57) ABSTRACT

A gas turbine engine component made of a nickel-based superalloy, the gas turbine engine component comprising a protective coating. The protective coating includes an inner diffusion barrier layer including any one or any combination of elements selected from the group consisting of platinum, palladium, tantalum, tungsten, hafnium and iridium, and an outer layer of hard material formed of hard particles embedded in a matrix.

19 Claims, 3 Drawing Sheets

(51) Int. Cl.

| | |
|---|---|
| ***F01D 5/02*** | (2006.01) |
| ***F01D 5/20*** | (2006.01) |
| ***C25D 7/00*** | (2006.01) |
| ***C25D 15/00*** | (2006.01) |
| *C25D 5/12* | (2006.01) |

(52) U.S. Cl.

CPC ..... *F01D 5/20* (2013.01); *C25D 5/12* (2013.01); *F05D 2220/32* (2013.01); *F05D 2230/30* (2013.01); *F05D 2230/90* (2013.01); *F05D 2300/175* (2013.01); *F05D 2300/177* (2013.01); *F05D 2300/516* (2013.01); *F05D 2300/6032* (2013.01)

(56) References Cited

U.S. PATENT DOCUMENTS

| | | | | |
|---|---|---|---|---|
| 5,427,866 | A * | 6/1995 | Nagaraj | B32B 15/01 416/241 B |
| 5,843,585 | A | 12/1998 | Alperine et al. | |
| 6,082,738 | A | 7/2000 | Peters et al. | |
| 6,335,105 | B1 | 1/2002 | McKee | |
| 6,455,167 | B1 | 9/2002 | Rigney et al. | |
| 6,533,285 | B2 | 3/2003 | Nava et al. | |
| 7,229,699 | B2 * | 6/2007 | Toth | C23C 4/02 29/898.12 |
| 2002/0145258 | A1 | 10/2002 | Nava et al. | |
| 2002/0197502 | A1 | 12/2002 | Zhao et al. | |
| 2005/0064227 | A1 | 3/2005 | Narita et al. | |
| 2005/0079368 | A1 * | 4/2005 | Gorman | C23C 4/02 428/469 |
| 2006/0040128 | A1 | 2/2006 | Gorman et al. | |
| 2007/0087210 | A1 | 4/2007 | Sahoo et al. | |
| 2008/0145629 | A1 | 6/2008 | Anoshkina et al. | |
| 2009/0110954 | A1 | 4/2009 | Allen et al. | |
| 2010/0330393 | A1 | 12/2010 | Hazel et al. | |
| 2011/0111190 | A1 | 5/2011 | Wei et al. | |
| 2011/0135489 | A1 * | 6/2011 | Strangman | C22C 19/058 416/241 R |
| 2013/0017072 | A1 | 1/2013 | Ali et al. | |
| 2016/0003065 | A1 * | 1/2016 | Stratton | C22C 19/058 416/241 R |
| 2016/0160661 | A1 * | 6/2016 | Balbach | C09K 3/1436 416/241 R |

FOREIGN PATENT DOCUMENTS

| | | | |
|---|---|---|---|
| DE | 102010015974 | A1 | 9/2011 |
| EP | 305113 | A2 | 3/1989 |
| EP | 0919699 | A2 | 6/1999 |
| EP | 1516943 | A2 | 3/2005 |
| EP | 1666629 | A2 | 6/2006 |
| EP | 2963144 | A2 | 1/2016 |
| EP | 3029113 | A1 | 6/2016 |
| FR | 2993901 | A1 | 1/2014 |
| GB | 2252981 | A | 8/1992 |
| GB | 2322869 | A | 9/1998 |
| GB | 2449862 | A | 12/2008 |
| WO | 2010/054633 | A2 | 5/2010 |
| WO | 2012/122373 | A1 | 9/2012 |
| WO | 2013/061945 | A1 | 5/2013 |
| WO | 2016/033301 | A1 | 3/2016 |

OTHER PUBLICATIONS

Sep. 30, 2016 Search Report issued in British Patent Application No. 1610768.2.

W.B.; "Protection of Gas Turbine Blades: A Platinum Barrier Layer for Nickel Alloys;" Platinum Metals Rev.; 1972; vol. 16; No. 3; p. 87.

Sep. 18, 2017 Search Report issued in British Patent Application No. 1705642.5.

* cited by examiner

GAS TURBINE ENGINE COMPONENT WITH PROTECTIVE COATING

FIELD OF THE INVENTION

The present invention relates to a gas turbine engine component with a protective coating.

BACKGROUND

Gas turbine engines have numerous sealing elements to limit or control air movement within the engine. For example, such elements can control leakage of hot working gas from the working gas annulus to disc cavities in the engine that contain cooling fluid. One method of forming a rotating seal is to reduce the clearance between adjacent components at a seal fin. This approach is used, for example, in labyrinth seals, which create resistance to airflow by forcing the air to traverse a series of such fins.

To obtain a small clearance between the components, an abrasive coating may be applied to the seal fins. FIG. 1 shows schematically a cross-section through a tip of a seal fin made of a nickel based superalloy and carrying an abrasive coating 32 which includes: an entrapment layer 36 of nickel in which the undersides of hard cubic boron nitride particles 38 are entrapped; a separation layer 34 of nickel which separates the boron nitride particles from the body 30 of the seal fin; and an infill 40 which encapsulates the boron nitride particles. The component can then be installed such that the seal fin is near a runner surface of the adjacent facing component. When the component having the seal fin rotates, the boron nitride particles abrade the softer material of the runner surface such that the seal fin forms a groove in the runner surface, providing a tight clearance between the seal fin and facing component.

The embodiment of hard particles such as boron nitride in such a coating may produce regions of high stress concentration in the coating adjacent to sharp points on the embedded particles. Cracks can initiate from these points, but in normal usage these cracks are deflected along the coating interfaces and thus do not enter the body of the component.

However, at high temperatures (e.g. temperatures greater than 600° C.) the coating may diffusion bond to the body of the component. This can be problematic because cracks initiated adjacent to the hard particles can then more easily propagate from the coating into the component across the diffusion bonded interface. Such cracks may eventually lead to fatigue failure of the component and thus reduce the component's functional lifespan.

SUMMARY

In general terms the present invention provides a component with a protective coating which reduces or prevents diffusion bonding of the coating to the component.

Accordingly, in a first aspect, the present invention provides a gas turbine engine component made of a nickel-based superalloy, the gas turbine engine component comprising a protective coating including:

- an inner diffusion barrier layer including any one or any combination of elements selected from the group consisting of platinum, palladium, tantalum, tungsten, hafnium and iridium, and
- an outer layer of hard material formed of hard particles embedded in a matrix.

The inner diffusion barrier layer reduces or prevents diffusion bonding of the outer layer to the component. The diffusion barrier layer may reduce or prevent diffusion bonding of the outer layer to the component by providing a limited mutual solubility between itself and one or more elements for immobilisation. In some examples, the diffusion barrier layer may prevent one or more selected elements from being transferred between the outer layer and the component. The diffusion barrier layer may also prevent one or more selected elements from being transferred between the diffusion barrier layer and the component. Thus, the diffusion barrier layer may not be diffusion bonded, in use, to the component. To ensure diffusion does not take place, the driving force for material migration may be limited to a driving force, according to the one or more selected elements, below the driving force required for diffusion bonding to occur.

The diffusion barrier layer may be any one or more of an inert material, metal or alloy. The diffusion barrier layer may be inert during use. The diffusion barrier layer may be inert in the environment of interest. The diffusion barrier layer may be either or both of a noble metal or alloy. The diffusion barrier layer may exclude the one or more elements selected for immobilisation. The diffusion barrier layer may exclude the element nickel, as an element selected for immobilisation, to reduce the driving force for material migration between either or both of the outer layer and the diffusion barrier layer and the component. Thus, in some examples, diffusion bonding between the component and either or both of the outer layer and the diffusion barrier layer may be at least partially reduced. In further examples, by the diffusion barrier layer excluding the element nickel, diffusion bonding between the component and either or both of the outer layer and the diffusion barrier layer may be prevented. Thus, the diffusion barrier layer may exclude the element nickel.

The diffusion barrier layer may provide the further advantage of reducing the propagation of cracks from the outer layer, and particularly cracks emanating from a stress-concentrating feature or particle at least partially contained within the composite layer, into the component. The diffusion barrier layer may provide the further advantage of preventing the propagation of cracks from the outer layer, and particularly cracks emanating from a stress-concentrating feature or particle at least partially contained within the composite layer, into the component. In some examples, the diffusion barrier layer may be provided in a structure comprising one or more layers. In some examples, the diffusion barrier layer may be provided in a structure comprising two or more layers. Thus, the inner diffusion barrier layer may comprise two or more layers. The or each layer may have a thickness of between 00.1 μm and 5 mm. The or each layer may have a thickness of between 0.1 μm and 3 mm. The or each layer may have a thickness of between 1 μm and 2 mm. The or each layer may have a thickness of between 10 μm and 1 mm. Thus, the diffusion barrier layer may retain a layered structure, in use. In some examples, the layered structure may retard or deflect crack propagation. This may be achieved by cracks propagating along or being blunted by a boundary between a first and second layer of the diffusion barrier layer. This damage mechanism may be preferable to cracks propagating either or both of from the outer layer to the component, or from the outer layer towards the component via the diffusion barrier layer.

In further examples, the diffusion barrier layer may be comprised of a material, metal or alloy having a vickers hardness which is lower than the vickers hardness of the outer layer. In further examples, the diffusion barrier layer may be comprised of a material, metal or alloy having a vickers hardness which is lower than the vickers hardness of the component. In further examples, the diffusion barrier layer may be comprised of a material, metal or alloy having a ductility which is greater than the ductility of the outer layer. In further examples, the diffusion barrier layer may be comprised of a material, metal or alloy having a ductility which is greater than vickers hardness of the component. Thus, cracks propagating into the diffusion barrier layer from either or both of the component or the outer layer may be arrested. This may be due to a plastic region being formed around the crack tip. The plastic region may provide any one of crack closure, no appreciate crack growth, or a retardation of crack growth rate relative to the crack growth rate expected under equivalent loading conditions should the plastic region not be present.

Thus, the diffusion barrier layer may increase the component's functional lifespan. By inhibiting this interdiffusion the barrier layer also facilitates removal of the coating at repair and overhaul.

In a second aspect, the present invention provides a gas turbine engine having a component according to the first aspect.

Another aspect of the present invention provides the use of a component of the first aspect in a gas turbine engine at temperatures above 600° C.

Optional features of the invention will now be set out. These are applicable singly or in any combination with any aspect of the invention.

The selected element(s) of the barrier layer may form at least 80% (and preferably at least 90% or 95%) by weight of the mass of the barrier layer. The barrier layer may consist substantially entirely of the selected element(s). The hard particles may be cubic boron nitride.

Preferably the inner diffusion barrier layer includes platinum.

The matrix may be Co—CrC, Ni or Ni alloy.

The outer layer may be electroplated.

The barrier layer may be electroplated, thermally sprayed, sputtered, or produced by CVD or PVD.

The protective coating may further include a separation layer of (e.g. electroplated) nickel between the diffusion barrier and the outer layer, the separation layer spacing the hard particles from the diffusion barrier layer.

The protective coating may further include an entrapment layer of (e.g. electroplated) nickel immediately beneath the outer layer, undersides of the hard particles of the outer layer being entrapped in the entrapment layer to hold the hard particles in position before encapsulation of the hard particles in the matrix of the outer layer.

The component may have one or more seal fins having the protective coating.

The component may be a rotor blade, a rotor disc, or a rotor drum. In the case of a rotor blade, the protective coating may be provided at the tip of the blade.

The inner diffusion barrier layer may consist of any one or any combination of elements selected from the group consisting of platinum, palladium, tantalum, tungsten, hafnium and iridium.

In a further aspect, the present invention provides a gas turbine engine component made of a nickel-based superalloy, the gas turbine engine component comprising a protective coating including:

- an inner diffusion barrier layer excluding nickel, but including any one or any combination of elements selected from the group consisting of platinum, palladium, tantalum, tungsten, hafnium and iridium, and
- an outer layer of hard material formed of hard particles embedded in a matrix.

The inner diffusion barrier layer reduces or prevents diffusion bonding of the outer layer to the component. By excluding the element nickel, diffusion bonding of the outer layer to the component is prevented. Advantageously, this also reduces or prevents the propagation of cracks from the outer layer, and particularly cracks emanating from a stress-concentrating feature or particle at least partially contained within the composite layer, into the component.

In a yet further aspect, the present invention provides a gas turbine engine component made of a nickel-based superalloy, the gas turbine engine component comprising a protective coating including:

- an inner diffusion barrier layer consisting of any one or any combination of elements selected from the group consisting of platinum, palladium, tantalum, tungsten, hafnium and iridium, and
- an outer layer of hard material formed of hard particles embedded in a matrix.

By limiting the combination of elements comprised within the diffusion barrier layer to any one or any combination of elements selected from the group consisting of platinum, palladium, tantalum, tungsten, hafnium and iridium, diffusion bonding of the outer layer to the component is prevented. Advantageously, this also reduces or prevents the propagation of cracks from the outer layer, and particularly cracks emanating from a stress-concentrating feature or particle at least partially contained within the composite layer, into the component.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES

Figure 1:
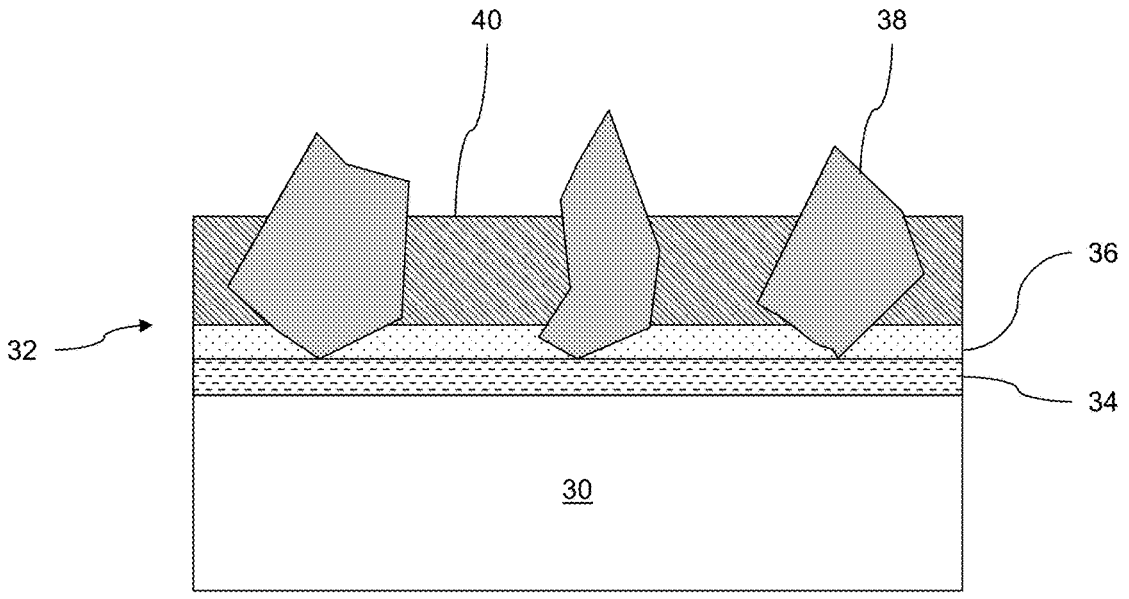
FIG. 1 shows schematically an abrasive coating on a cross-section through a tip of a seal fin.
Figure 2:
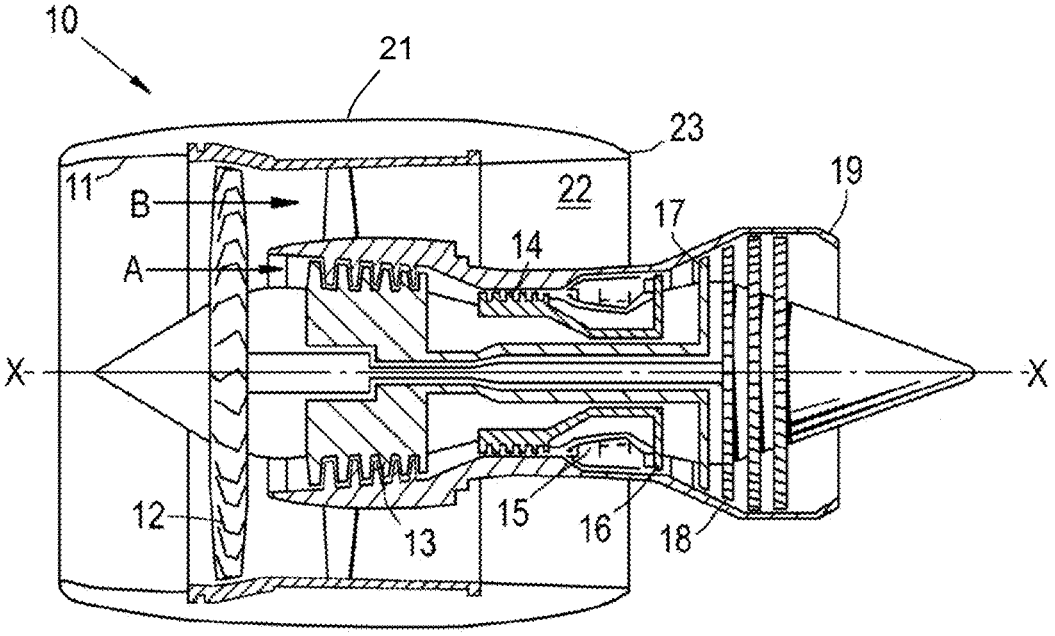
FIG. 2 shows a longitudinal cross-section through a ducted fan gas turbine engine.

With reference to FIG. 2, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate-pressure compressor 13 and a second air flow B which passes through the bypass duct 22 to provide propulsive thrust. The intermediate-pressure compressor 13 compresses the air flow A directed into it before delivering that air to the high-pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate-pressure compressors 14, 13 and the fan 12 by suitable interconnecting shafts.

The engine 10 has labyrinth seals radially inwards of the working gas annulus to control leakage of hot working gas from the annulus to disc cavities in the engine. These seals typically comprise a series of seal fins.

Figure 3:
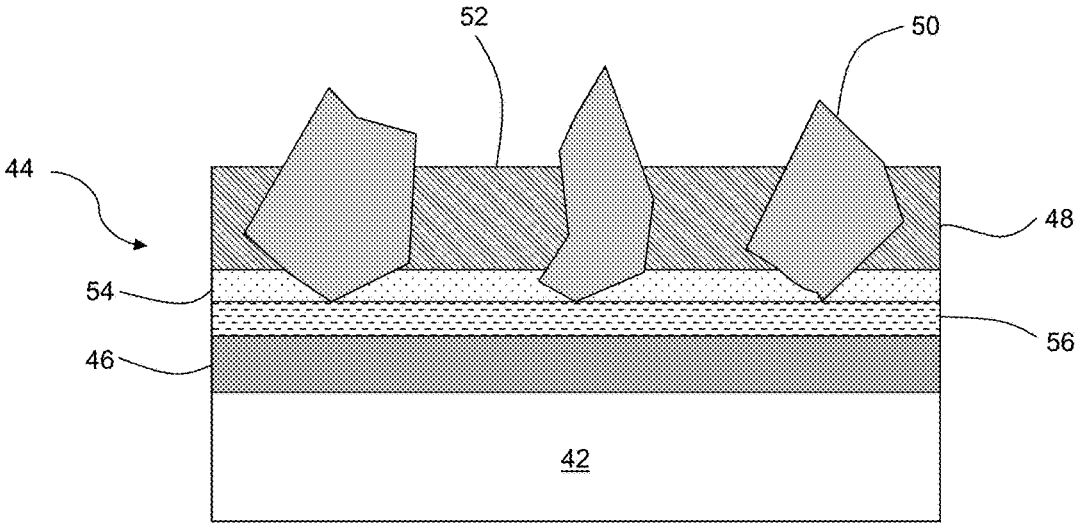
FIG. 3 shows schematically a protective coating on a cross-section through a tip of a seal fin according to the present invention.

FIG. 3 shows schematically a cross-section through a tip of a seal fin according to the present invention. The component which provides the seal fin is made of a nickel-based superalloy such as IN718, U720, 720Li or RR1000 and is installed in a gas turbine engine such that the seal fin is in contact with a runner surface of an adjacent facing component.

The tip of the seal fin is provided with a protective coating 44 which includes an outer layer 48 made of a hard material with hard particles 50 embedded in a matrix 52. The hard particles may be cubic boron nitride particles and the matrix in which the particles are embedded may be Co—CrC, Ni or Ni alloy. When the component is installed in a gas turbine engine, the hard particles in the outer layer abrade the softer material of the runner surface to form a groove in the runner surface.

Below the outer layer 48, the protective coating 44 has a nickel entrapment layer 54 which entraps the undersides of the hard particles 50 to hold the particles in place before they are encapsulated in the matrix 52.

Below the entrapment layer 54, the protective coating 44 has a nickel separation layer 56 which spaces the particles 50 from the main body 42 of the seal fin.

In this way, the matrix 52 is shown to be a thickness which is less than the longest dimension of the hard particles 50 so that one or more of the hard particles 50 extend from the nickel entrapment layer 54 through the matrix 52 so as to protrude from the surface of the outer layer 48.

In some examples, one or more of the hard particles 50 extend from the nickel entrapment layer 54 through the matrix 52 without protruding from the surface of the outer layer 48. In further examples, one or more of the hard particles 50 are completely contained within the matrix 52 without protruding from the surface of the outer layer 48

In some examples, the matrix 52 is of a thickness which is less than the longest dimension of the hard particles 50 so that at least about 10% (by number) of the hard particles 50 extend from the nickel entrapment layer 54 through the matrix 52 so as to protrude from the surface of the outer layer 48. Alternatively, at least about 50% (by number) of the hard particles 50 extend from the nickel entrapment layer 54 through the matrix 52 so as to protrude from the surface of the outer layer 48. Alternatively, at least about 80% (by number) of the hard particles 50 extend from the nickel entrapment layer 54 through the matrix 52 so as to protrude from the surface of the outer layer 48. In final examples, at least about 90% (by number), or 95% (by number) of the hard particles 50 extend from the nickel entrapment layer 54 through the matrix 52 so as to protrude from the surface of the outer layer 48.

In some examples, the matrix 52 is of a thickness greater than the longest dimension of at least some of the hard particles 50 so that one or more of the hard particles 50 are completely contained within the matrix 52. Such hard particles 50 embedded within the matrix 52 provide added resistance to abrasion of the outer layer 48 by such abrasion revealing further hard particles 50. The revealing of further hard particles 50 provides added abrasive effect and prevents rapid wear of the outer layer 48 should hard particles 50 become worn or dislodged from the matrix 52. Where the matrix 52 is of a thickness equal to or greater than the longest dimension of the hard particles 50, it is required that one or more hard particles 50 protrude from the matrix 52 in order to provide an abrasive effect.

Where the matrix 52 is of a thickness which is less than, equal to, or greater than the longest dimension of at least some of the hard particles 50, the thickness of either or both of the matrix 52 and particle size distribution can vary so as to allow only a particular percentage (by number) of hard particles 50 to protrude from the matrix 52.

The protective coating 44 also has a diffusion barrier layer 46 located between the nickel-based main body 42 of the seal fin and the separation layer 56. The protective coating includes any one or any combination of platinum, palladium, tantalum, tungsten, hafnium and iridium, and it reduces or prevents the diffusion of either or both of nickel and other elements thereacross. Such diffusion can be particularly problematic at temperatures above 600° C. The diffusion barrier layer 46 thus reduces or prevents diffusion bonding of the protective coating 44 to the main body 42 of the seal fin. In this way, the propagation of cracks initiated at the hard particles 50 into the seal fin can be avoided. Thus, the likelihood of fatigue failure of the component occurring is reduced and the component's functional lifespan may be increased. In further examples, to reduce or prevent the diffusion of nickel between the nickel-based main body 42 of the seal fin and the separation layer 56, the diffusion barrier layer 46 excludes the element nickel. In yet further examples, to reduce or prevent the diffusion of nickel between the nickel-based main body 42 of the seal fin and the separation layer 56, the diffusion barrier layer 46 consists of (i.e. exclusively includes) any one or any combination of elements selected from the group consisting of platinum, palladium, tantalum, tungsten, hafnium and iridium.

For improved diffusion bonding protection, the selected element(s) of the barrier layer may form at least 80% (and preferably at least 90% or 95%) by weight of the mass of the barrier layer. Indeed, the barrier layer may consist substantially entirely of the selected element(s).

The diffusion barrier layer 46, separation layer 56, entrapment layer 54 and outer layer 48 may be applied by successive electroplating procedures. For example, Praxair Surface Technologies TBT406™ electroplating process or Abrasive Technologies ATA3C™ electroplating process may be used to form the separation, entrapment and outer layers. However, methods such as thermal spraying, plasma vapour deposition, chemical vapour deposition and sputtering may be used as appropriate to form any one or more of the layers.

While the invention has been described in conjunction with the exemplary embodiments described above, many equivalent modifications and variations will be apparent to those skilled in the art when given this disclosure. For example, the diffusion barrier layer can be applied to other coating systems where there is an outer layer of hard material formed of hard particles embedded in a matrix, and a risk of diffusion bonding of that layer to an underlying nickel-based superalloy substrate.

Moreover, the invention is not limited to seal fin applications. For example, in a gas turbine engine context, the protective coating can be usefully applied to the tips of rotor blades, thereby enhancing the ability of the blades to abrade surrounding casings. It can also be applied to rotor discs or rotor drums.

Accordingly, the exemplary embodiments of the invention set forth above are considered to be illustrative and not limiting. Various changes to the described embodiments may be made without departing from the spirit and scope of the invention.

The invention claimed is:

1. A gas turbine engine component made of a nickel-based superalloy, the gas turbine engine component comprising a protective coating including:

a diffusion barrier layer including any one or any combination of elements selected from the group consisting of platinum, palladium, tantalum, tungsten, hafnium and iridium, an outer layer of hard material formed of hard particles embedded in a matrix, and an entrapment layer of nickel immediately beneath the outer layer; wherein the diffusion barrier layer prevents diffusion bonding of the protective coating to the gas turbine engine component;

the diffusion barrier layer of the protective coating is formed directly on the gas turbine engine component, the diffusion barrier layer and the outer layer being applied to the gas turbine engine component by successive procedures, the successive procedures being selected from the group consisting of electroplating, thermal spraying, plasma vapour deposition, chemical vapour deposition and sputtering, and the matrix of the outer layer has a thickness which is less than the longest dimension of the hard particles so that one or more of the hard particles extend from the nickel entrapment layer through the matrix so as to protrude from the surface of the outer layer.

2. A component according to claim 1, wherein the selected element(s) of the diffusion barrier layer form at least 80% by weight of the mass of the diffusion barrier layer.

3. A component according to claim 1, wherein the hard particles are cubic boron nitride.

4. A component according to claim 1, wherein the matrix is Co—CrC, Ni or Ni alloy.

5. A component according to claim 1, wherein the outer layer and the diffusion barrier layer are applied by successive electroplating procedures.

6. A component according to claim 1, wherein the protective coating further includes a separation layer of nickel between the diffusion barrier layer and the outer layer, the separation layer spacing the hard particles from the diffusion barrier layer, and the separation layer is applied on the diffusion barrier layer, before the application of the outer layer, by a procedure selected from the group consisting of electroplating, thermal spraying, plasma vapour deposition, chemical vapour deposition and sputtering.

7. A component according to claim 1, wherein a side of the hard particles of the outer layer being entrapped in the entrapment layer to hold the hard particles in position before encapsulation of the hard particles in the matrix of the outer layer, and the entrapment layer is applied, before the application of the outer layer, by a procedure selected from the group consisting of electroplating, thermal spraying, plasma vapour deposition, chemical vapour deposition and sputtering.

8. A component according to claim 1, wherein the component has one or more seal fins having the protective coating.

9. A component according to claim 1, wherein the component is a rotor blade, a rotor disc or rotor drum.

10. A component according to claim 1, wherein the diffusion barrier layer does not comprise the element nickel.

11. A component according to claim 1, wherein the diffusion barrier layer consists of any one or any combination of elements selected from the group consisting of platinum, palladium, tantalum, tungsten, hafnium and iridium.

12. A component according to claim 1, wherein the diffusion barrier layer comprises two or more layers.

13. A gas turbine engine having a component according to claim 1.

14. A method comprising: introducing the component according to claim 1 to a gas turbine engine, wherein the component is exposed to temperatures above 600° C. during use of the component.

15. A gas turbine engine component made of a nickel-based superalloy, the gas turbine engine component comprising a protective coating including:

a diffusion barrier layer excluding nickel, but including any one or any combination of elements selected from the group consisting of platinum, palladium, tantalum, tungsten, hafnium and iridium, an outer layer of hard material formed of hard particles embedded in a matrix, and an entrapment layer of nickel immediately beneath the outer layer; wherein the diffusion barrier layer prevents diffusion bonding of the protective coating to the gas turbine engine component, the diffusion barrier layer and the outer layer are applied by successive procedures, the successive procedures being selected from the group consisting of electroplating, thermal spraying, plasma vapour deposition, chemical vapour deposition and sputtering, and the matrix of the outer layer has a thickness which is less than the longest dimension of the hard particles so that one or more of the hard particles extend from the nickel entrapment layer through the matrix so as to protrude from the surface of the outer layer.

16. A gas turbine engine component made of a nickel-based superalloy, the gas turbine engine component comprising a protective coating including:

a diffusion barrier layer consisting of any one or any combination of elements selected from the group consisting of platinum, palladium, tantalum, tungsten, hafnium and iridium, an outer layer of hard material formed of hard particles embedded in a matrix, and an entrapment layer of nickel immediately beneath the outer layer; wherein the diffusion barrier layer prevents diffusion bonding of the protective coating to the gas turbine engine component, the diffusion barrier layer and the outer layer are applied by successive procedures, the successive procedures being selected from the group consisting of electroplating, thermal spraying, plasma vapour deposition, chemical vapour deposition and sputtering, and the matrix of the outer layer has a thickness which is less than the longest dimension of the hard particles so that one or more of the hard particles extend from the nickel entrapment layer through the matrix so as to protrude from the surface of the outer layer.

17. A component according to claim 1, wherein at least about 50%, by number, of the hard particles extend from the nickel entrapment layer through the matrix so as to protrude from the surface of the outer layer.

18. A component according to claim 1, wherein at least about 80%, by number, of the hard particles extend from the nickel entrapment layer through the matrix so as to protrude from the surface of the outer layer.

19. A component according to claim 1, wherein at least about 95%, by number, of the hard particles extend from the nickel entrapment layer through the matrix so as to protrude from the surface of the outer layer.

* * * * *